United States Patent [19]

Hyodo et al.

[11] Patent Number: 4,667,612

[45] Date of Patent: May 26, 1987

[54] THREAD WINDING SAFETY DEVICE OF A SEWING MACHINE

[75] Inventors: Tohru Hyodo; Toru Kakubari, both of Tokyo, Japan

[73] Assignee: Janome Sewing Machine Co. Ltd., Tokyo, Japan

[21] Appl. No.: 761,103

[22] Filed: Jul. 31, 1985

[30] Foreign Application Priority Data

Jul. 31, 1984 [JP] Japan ..... 59-158583

[51] Int. Cl.[4] ..... D05B 69/36; D05B 59/00

[52] U.S. Cl. ..... 112/277; 112/279; 112/453

[58] Field of Search ..... 112/277, 279, 275, 220, 112/221, 453

[56] References Cited

U.S. PATENT DOCUMENTS 4,195,585 4/1980 Takahashi et al. ..... 112/277

4,519,328 5/1985 Takenoya et al. ..... 112/279 X 4,527,496 7/1985 Kemmel ..... 112/279

*Primary Examiner*—Peter Nerbun

*Attorney, Agent, or Firm*—Michael J. Striker

[57] ABSTRACT

In the invention, the sewing machine carries out winding of the thread by operating separately a thread winding mechanism and a clutch mechanism. A speed detector is provided to measure actual rotary speed of a mechanism which is related with rotation of an upper shaft. If the thread winding were carried out, while said mechanism is left as engaged with a power source of the sewing machine, the speed detector would detect the rotation of said mechanism to stop a machine motor instantaneously, so that the thread winding cannot be performed when said relative mechansim is not released from the power source, and the needle bar is not actuated at winding the thread for safety in operation.

2 Claims, 2 Drawing Figures

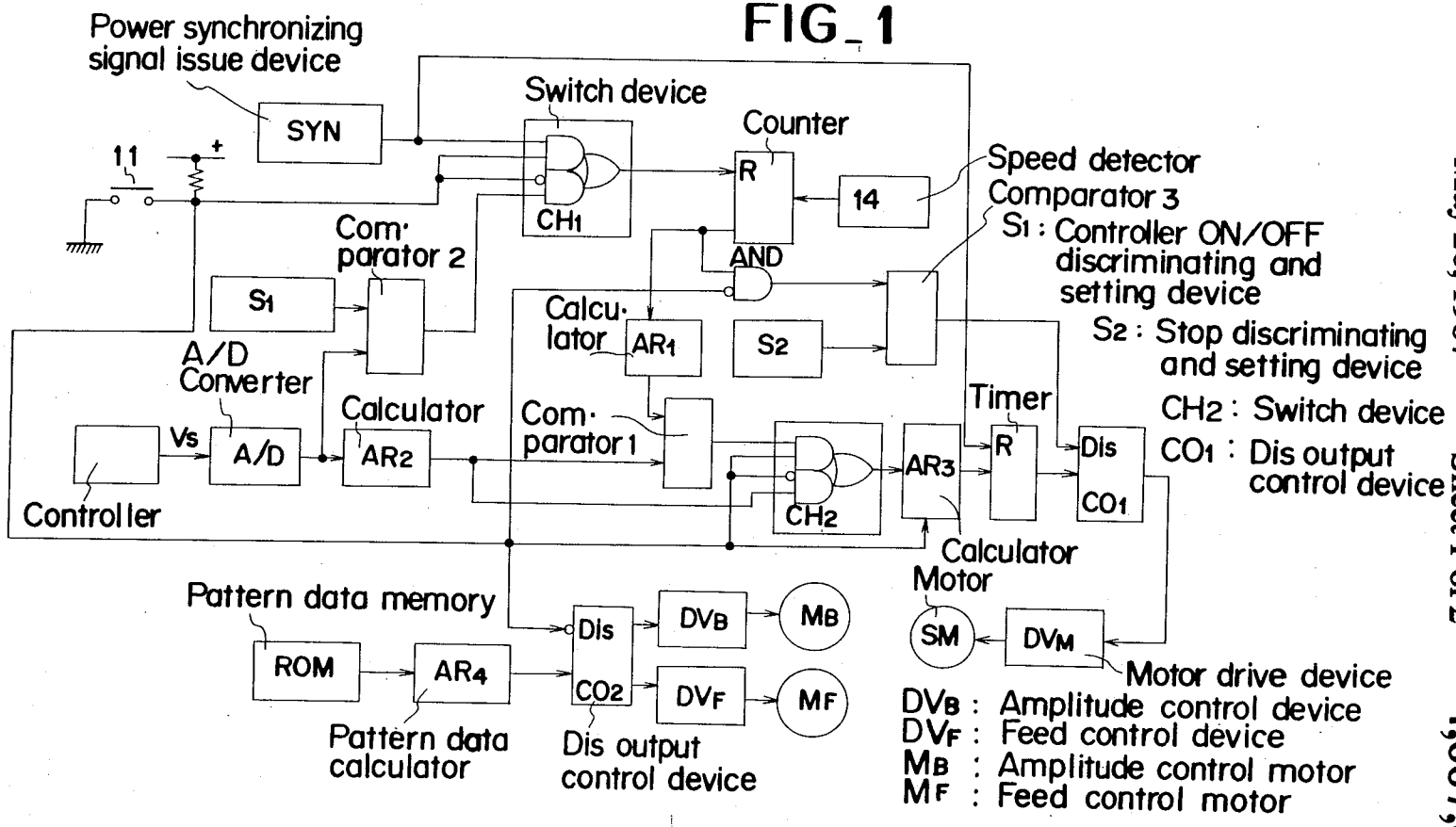
FIG_1
Power synchronizing signal issue device
SYN
11
+
Switch device
CH1
Counter
R
14
AND
Speed detector
Comparator 3
S1 : Controller ON/OFF discriminating and setting device
S2 : Stop discriminating and setting device
S1
S2
Com-parator 2
A/D Converter
A/D
Vs
Controller
Calcu-lator
AR1
Com-parator 1
Calculator
AR2
CH2 : Switch device
CO1 : Dis output control device
CH2
AR3
Timer
R
Dis
CO1
Calculator
Motor
SM
Motor drive device
DVM
DVB : Amplitude control device
DVF : Feed control device
MB : Amplitude control motor
MF : Feed control motor
MB
MF
DVB
DVF
Dis output control device
Dis
CO2
Pattern data memory
ROM
AR4
Pattern data calculator

THREAD WINDING SAFETY DEVICE OF A SEWING MACHINE

FIELD OF THE INVENTION

This invention relates to drive control for winding a thread of a computerized sewing machine, and more particularly to a safety device for safeguarding the thread winding operation.

BACKGROUND OF THE INVENTION

A switching means between a normal stitching and a thread winding depends upon two operations.

In a conventional sewing machine, the thread winding mechanism is engaged with a power source of the sewing machine, and a clutch mechanism is operated so that a mechanism related with rotation of an upper shaft is separated from the power source. If an operation of a clutch mechanism were forgot and the thread were wound, a needle bar would be actuated together with the thread winding. Such an accident is not desirable for the safety of operation.

SUMMARY OF THE INVENTION

In the invention, the sewing machine carries out winding of the thread by operating separately a thread winding mechanism and a clutch mechanism. A speed detector is provided to measure actual rotary speed of a mechanism which is related with rotation of an upper shaft. If the thread winding were carried out, while said mechanism is left as engaged with a power source of the sewing machine, the speed detector would detect the rotation of said mechanism to stop a machine motor instantaneously, so that the thread winding cannot be performed when said mechanism is not released from the power source, and the needle bar is not actuated at winding the thread for safety in operation.

BRIEF DESCRIPTION OF THE DRAWINGS

FIG. 1 is a control block circuit diagram showing an embodiment of the drive control according to the invention.

DETAILED DESCRIPTION OF THE INVENTION

Figure 2:
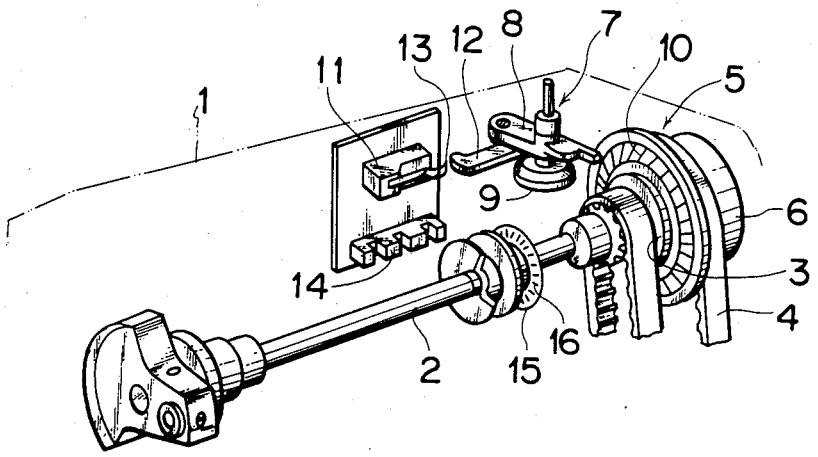
FIG. 2 is a perspective view of a structural part of a sewing machine.

An explanation will be made with reference to an embodiment of the invention shown in the attached drawings.

FIG. 2 is an elementary part of a sewing machine 1. An upper shaft 2 is detachably connected with a pulley 5 and driven by a power transmitted via a clutch mechanism 3 from a motor belt 4. A clutch engagement operating part (not shown) is engaged with a knob provided centrally by a flywheel 6 by turning the knob leftward, and a stitching condition is prepared. By turning the knob rightward, the engagement is cancelled.

A thread winding mechanism 7 is made ready for an operation by displacing an engaging mechanism 8 so that a rubber wheel 9 is urged to a knurl 10 of the pulley 5.

A thread winding switch 11 is normally OFF, and when the rubber wheel 9 engages the pulley 5, a switch lever 12 acts on an actuator 13 and the switch 11 is made ON. This switch 11 discriminates between the engagement or separation of the pulley 5 with respect to the thread winding mechanism 7.

A speed detector 14 detects rotation speed of the upper shaft 2, and issues a pulse signal each time a slit 16 of an optical plate 15 mounted on the upper shaft 2 passes by the speed detector 14.

FIG. 1 is a control block diagram of a control circuit, and main controls are performed by a micro computer. A power source synchronizing signal generator (SYN) issue a H level pulse signal each time when difference in potential between two lines of an AC power source applied to the sewing machine, is 0.

A counter (COUNT) is at reset when its reset terminal (R) is at H level, and counts pulse signals of a speed detector 14 and outputs signals of counted values.

When the thread winding switch 11 is OFF, that is, during stitching, a switching device (CH1) renders the signal of the generator (SYN) effective to the counter (COUNT) by means of said H level signal, and resets it each time at the 0 level of the electric potential of the power source.

A controller (CONT) designates the desired speed of a machine motor (SM) and issues signals (VS) corresponding to a DC voltage level in response to said designation.

An analog to digital converter (A/D) converts the voltage level (VS) into a digital value.

A calculator (AR1) calculates, from the value of the counter (COUNT), data expressing periods, that is, data corresponding to time (sec.) to be taken by moving about a unit rotational angle of a machine motor (SM).

A calculator (AR2) calculates the digital value of the converter (A/D) into desired time data of the same unit as the data of the calculator (AR1), and a comparator (COMP1) compares said data and issues data corresponding to the difference between outputs of the calculators AR1 and AR2.

A switching device (CH2) outputs the data of the comparator (COMP1) to a calculator (AR3) when the thread winding switch 11 is OFF.

The calculator (AR3) controls a time at setting of a timer (T) for controlling actuation phase of the machine motor (SM) when the thread winding switch 11 is OFF.

The timer (T) is reset per each of H levels of the power source synchronizing generator (SYN), and loads the setting time data of the calculator (AR3) and starts its timing operation.

When the value of the calculator (AR1), i.e., the actual value is, e.g., smaller than the value of the calculator (AR2), i.e., a desired value per each of the starts, the calculator (AR3) reduces the setting time of the timer (T) below the value loaded in the preceding time interval in response to the difference between the calculators (AR1) and (AR2) in order to accelerate the motor actuation phase, and feeds it back. The timer (T) outputs H level signal each time when the set time expires, and at this moment an output control device (CO1) causes a machine motor drive device ($DV_M$) to control the actuation phase of the machine motor (SM).

A pattern data memory (ROM) supplies control data of the needle amplitude amount and the fabric feed amount with respect to stitches of a selected pattern.

A pattern data calculator (AR4) calculates the moving amounts of the needle amplitude and the fabric feed from the control data from the memory (ROM).

An output control device (CO2) drives an amplitude control motor ($M_B$) and a feed control motor ($M_F$) via an amplitude drive device ($DV_B$) and a feed drive device ($DV_F$) in accordance with the output value of calculator (AR4).

Another explanation of the operation of the circuit of FIG. 1 will be made in relation with ON position of the thread winding stitch 11. A switching device (CH2) applies the output of the calculator (AR2) to the calculator (AR3) in response to the L level signal produced upon ON position of the switch 11, and at this time, the calculator (AR3) sets the time of the timer (T) in accordance with the data of the calculator (AR2). Therefore, the machine motor (SM) is operated with open control in accordance with the speed designation of the controller (CONT).

The comparator (COMP2) resets the counter (COUNT) each time when the controller (CONT) is operated, and receives the signals from A/D converter and a controller ON/OFF discriminating device (S1). This device (S1) sets digital values for judging whether the value of A/D converter is for the ON or OFF condition of the controller (CONT).

A switching device (CH2) renders the comparator (COMP2) effective to the counter (COUNT) by L level signal in response to ON of the thread winding switch (11), and resets the counter (COUNT) when the controller (CONT) is operated.

AND gate (AND) renders the output of the counter (COUNT) effective to the comparator (COMP3) by the L signal in response to ON of the thread winding switch 11, and at this time the comparator (COMP3) compares the data of the counter (COUNT) with setting values of a stop discriminating device (S2), and gives, when both are met, a signal to an output prohibiting terminal (Dis) of the output control device (CO1), and stops the machine motor (SM).

The stop discriminating device (S2) sets the same pulse number or value as that issued by the speed detector 14 upon the determination of the rotation angle of upper shaft 2, and the comparator (COMP3) exactly discriminates that the upper shaft 2 is rotated by the machine motor (SM) and that the counter (COUNT) counts said pulse value.

The output control device (CO2) receives at its input (Dis) and L level signal caused by ON condition of the switch 11, and at this time it fixes the amplitude control motor ($M_B$) and the feed control motor ($M_F$) at their present positions.

A further explanation of the operation of the control circuit will be made as to the actuation of the thread winding switch 11 in the above mentioned structure. When the thread winding switch 11 is turned ON the rubber wheel 9 is engaged with the knurl 10 of the pulley 5. An operating portion (not shown) of the clutch mechanism 3 is operated to release the upper shaft 2 from the power transmitting pulley 5, and when the controller (CONT) is operated, the machine motor (SM) is rotated as will be mentioned below, thereby enabling to wind the thread without actuating the stitching mechanism of the sewing machine. When the controller (CONT) is operated, the comparator (COMP2) is at H level and the counter (COUNT) is reset. The speed detector 14 does not issue the pulse signal and the comparator (COMP3) does not give an output. The calculator (AR3) receives the data of the calculator (AR2) and sets the timer (T) at the time in accordance with the time designation of the controller (CONT). The machine motor (SM) is speed-controlled by the conductive electric current of the actuation phase in response to said time designation. At this time, the amplitude control motor ($M_B$) and the feed control motor ($M_F$) are stopped at the present positions.

If the operation of the clutch mechanism 3 is neglected by the operator, and the upper shaft 2 and the pulley 5 are left engaged, the speed detector 14 would issue pulse signals simultaneously with the rotation of the machine motor (SM).

The counter (COUNT) is reset by starting operation of the controller (CONT), and subsequently counts the pulses of the speed detector 14 together with the rotation of the machine motor (SM). The comparator (COMP3) receives the counted value and compares it with the setting value of the stop discriminating device (S2), and prohibits, when the both are met, the output of the output control device (CO1). The counting continues until this stop occurs after a fraction of the rotation of the sewing machine, and the sewing machine is stopped about half rotation, including inertia of the sewing machine.

The safety device according to the invention is reliable in operation by means of the electronic control only, without adding any mechanical parts or switches to the conventional device. The control enables a program control by the micro computer and additions of memories are easy to accomplish.

What is claimed is:

1. A thread winding safety device for a computerized sewing machine of the type having an upper drive shaft, a pulley mounted on the upper drive shaft and operatively connected to a machine drive motor to be rotated thereby, a clutch arranged between the upper drive shaft and the pulley and operated to connect the upper drive shaft to the pulley and to disconnect the upper shaft from the pulley, a thread winding mechanism movable between a first position in which it is spaced from the pulley and a second position in which it engages the pulley to be rotated thereby, the sewing machine further including a counter which is reset in response to a signal of a synchronizer produced at the zero potential difference between the positive and negative potentials of an alternating current power source, to thereby start the count up of a pulse signal produced by a rotation speed detector and produce a pulse count up signal, a first calculator for calculating from the pulse count up signal a signal representing the actual rotation speed of the machine drive motor, a controller selectively activated or inactivated to produce or cancel a voltage level signal for rotating the machine drive motor, means for changing the voltage level signal into a digital signal, a second calculator for calculating from the digital signal a signal designating the desired rotation speed of the machine drive motor, a first comparator for comparing the actual rotation speed signal and the designated rotation speed signal and producing a comparison signal, and a third calculator operated in response to the comparison signal to make a feed back control of the actual rotation speed of the machine drive motor when the value of the actual rotation speed signal is smaller than the value of the designated rotation speed signal, said thread winding safety device comprising switching means normally opened and closed in response to the movement of said thread winding mechanism into said second position to thereby produce an electric signal; first storage means storing a signal for confirming the presence of said digital signal which is produced due to the activation of said controller or another signal for confirming the absence of said digital signal upon inactivation of said controller; a second comparator for comparing the two confirmation signals and producing an output signal when the presence of said digital signal is confirmed; first signal switching means responsive to said electric signal from said switching means to make effective said output signal from said second comparator to reset said counter while making ineffective said signal from said synchronizer; second signal switching means responsive to said electric signal from said switching means to apply said designated rotation speed signal from said second calculator to said third calculator to thereby control the actual rotation speed of said machine drive motor; second storage means storing a signal of a predetermined value; a third comparator for comparing said signal stored in said second storage means and said pulse count up signal of said counter means responsive to said electric signal of said switching means to apply said pulse count up signal of said counter to said third comparator, said third comparator comparing said pulse count up signal until the count up signal reaches said value of the signal stored in said second storage means, and then producing an output signal for stopping said machine drive motor.

2. The thread winding safety device as defined in claim 1, wherein said sewing machine further includes an electronic memory for storing stitch control data for different stitch patterns, a first control motor activated under the control of said stitch control data to control a needle position of the sewing machine, and a second control motor activated under the control of said stitch control data to control a fabric feeding amount of the sewing machine, said safety device further comprising control means responsive to said electric signal of said switching means to produce an output signal for preventing said first and second control motors from being activated.

* * * * *